US005469730A

United States Patent [19]

Heaman

[11] Patent Number: 5,469,730

[45] Date of Patent: Nov. 28, 1995

[54] PIPE BENDING MACHINE

[76] Inventor: Norman L. Heaman, 11 Meadow Crescent, Edmonton, Alberta, Canada, T6C 1G1

[21] Appl. No.: 322,144

[22] Filed: Oct. 13, 1994

[51] Int. Cl.[6] ..... B21D 9/08

[52] U.S. Cl. ..... 72/389; 72/383

[58] Field of Search ..... 72/381, 383, 389, 72/390

[56] References Cited

U.S. PATENT DOCUMENTS

| | | | |
|---|---|---|---|
| 96,684 | 11/1869 | Emerson . | |
| 520,078 | 5/1894 | Phillips . | |
| 754,562 | 3/1904 | Hintz . | |
| 799,654 | 9/1905 | Kern . | |
| 916,040 | 3/1909 | Shaw | 72/390 |
| 1,079,442 | 11/1913 | Rutledge . | |
| 1,118,046 | 11/1914 | Poffinbarger | 72/413 |
| 1,156,062 | 10/1915 | Crellin | 72/413 |
| 1,682,149 | 8/1928 | Robertson . | |
| 1,776,082 | 7/1929 | Peterson | 72/413 |
| 3,344,630 | 12/1964 | Lauck . | |
| 3,344,635 | 10/1967 | Van Allen . | |
| 3,586,057 | 6/1971 | Lambert | 72/389 |
| 3,861,186 | 1/1975 | Wigner, Jr. | 72/217 |
| 4,719,783 | 1/1988 | Corry | 72/217 |
| 4,782,686 | 11/1988 | Carson, Jr. | 72/389 |
| 4,981,030 | 1/1991 | Caporusso et al. | 72/158 |
| 4,986,104 | 1/1991 | Caporusso et al. | 72/158 |
| 4,987,760 | 1/1991 | Schulte | 72/306 |
| 5,123,272 | 6/1992 | Heaman | 72/389 |
| 5,148,695 | 9/1992 | Ellis | 72/158 |

FOREIGN PATENT DOCUMENTS

| | | | |
|---|---|---|---|
| 0271689 | 3/1966 | Australia | 72/389 |
| 0562718 | 6/1960 | Belgium | 72/389 |
| 0159905 | 4/1905 | Germany | 72/413 |
| 0588582 | 2/1959 | Italy | 72/389 |
| 0136232 | 10/1981 | Japan | 72/390 |
| 0184021 | 10/1983 | Japan | 72/389 |
| 0002482 | of 1902 | United Kingdom | 72/389 |

OTHER PUBLICATIONS

12 Ton Hydraulic Pipe Bender from Northern Hydraulics "Popular Science" Jan. 1994.

*Primary Examiner*—David Jones

*Attorney, Agent, or Firm*—Anthony R. Lambert

[57] ABSTRACT

A pipe bending machine is described which utilizes a cord and lattice support structure having a first end, a second end, an interior lattice framework and an exterior connecting cord which connects the periphery of the interior lattice framework. Pipe securing tie backs are secured to the support structure adjacent each of the first end and the second end. At least one pressure exerting hydraulic cylinder is secured to the support structure intermediate the first end and the second end. The hydraulic cylinder has a pressure member movable in relation to the support structure thereby exerting a bending force upon a pipe held by the pipe securing means. The bending force places the interior lattice framework in compression and the connecting cord in tension. The forces of compression and tension being off-setting thereby enabling the support structure to withstand the bending force. The cord and lattice support structure, as described, enables the pipe bending machine to be made light enough to be carried by one man to remote locations along a pipeline right of way or other such construction sites.

6 Claims, 3 Drawing Sheets

PIPE BENDING MACHINE

The present invention relates to a pipe bending machine.

BACKGROUND OF THE INVENTION

There is no shortage of pipe bending machines that are capable of bending pipe between 2 inches and six inches in diameter. The problem is that such machines are too heavy to permit one or two men to easily carry them along remote pipeline right of ways.

SUMMARY OF THE INVENTION

What is required is a pipe bending machine that is sufficiently light to be portable and yet sufficiently strong to withstand the pressures required to bend pipe.

According to the present invention there is provided a pipe bending machine which includes a cord and lattice support structure having a first end, a second end, an interior lattice framework and an exterior connecting cord which connects the periphery of the interior lattice framework. Pipe securing means are secured to the support structure adjacent each of the first end and the second end. Pressure exerting means are secured to the support structure intermediate the first end and the second end. The pressure exerting means have a pressure member movable in relation to the support structure thereby exerting a bending force upon a pipe held by the pipe securing means. The bending force places the interior lattice framework in compression and the connecting cord in tension. The forces of compression and tension being off-setting thereby enabling the support structure to withstand the bending force.

The support structure described, although light weight, has considerable strength. It can easily be carried down a pipeline right of way and used at remote locations. The preferred type of pressure exerting means is a pair of hydraulic cylinders. An hydraulic pump and power supply can either be incorporated into the design of the pipe bending machine, or carried separately and connect on site. The preferred form of interior lattice framework includes a primary member which extends between the first end and the second end, and a plurality of secondary members extending radially outwardly from a midpoint of the primary member. Beneficial results have been obtained with two secondary members extending radially outwardly from the midpoint of the primary member at an angle of 45 degrees.

Although beneficial results may be obtained through the use of the pipe bending machine, as described above, it is important that portion of the pressure exerting means that engages the pipe be simple and light weight in construction. Even more beneficial results may, therefore, be obtained when the pressure exerting means includes a pipe engaging cradle with a flexible membrane.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
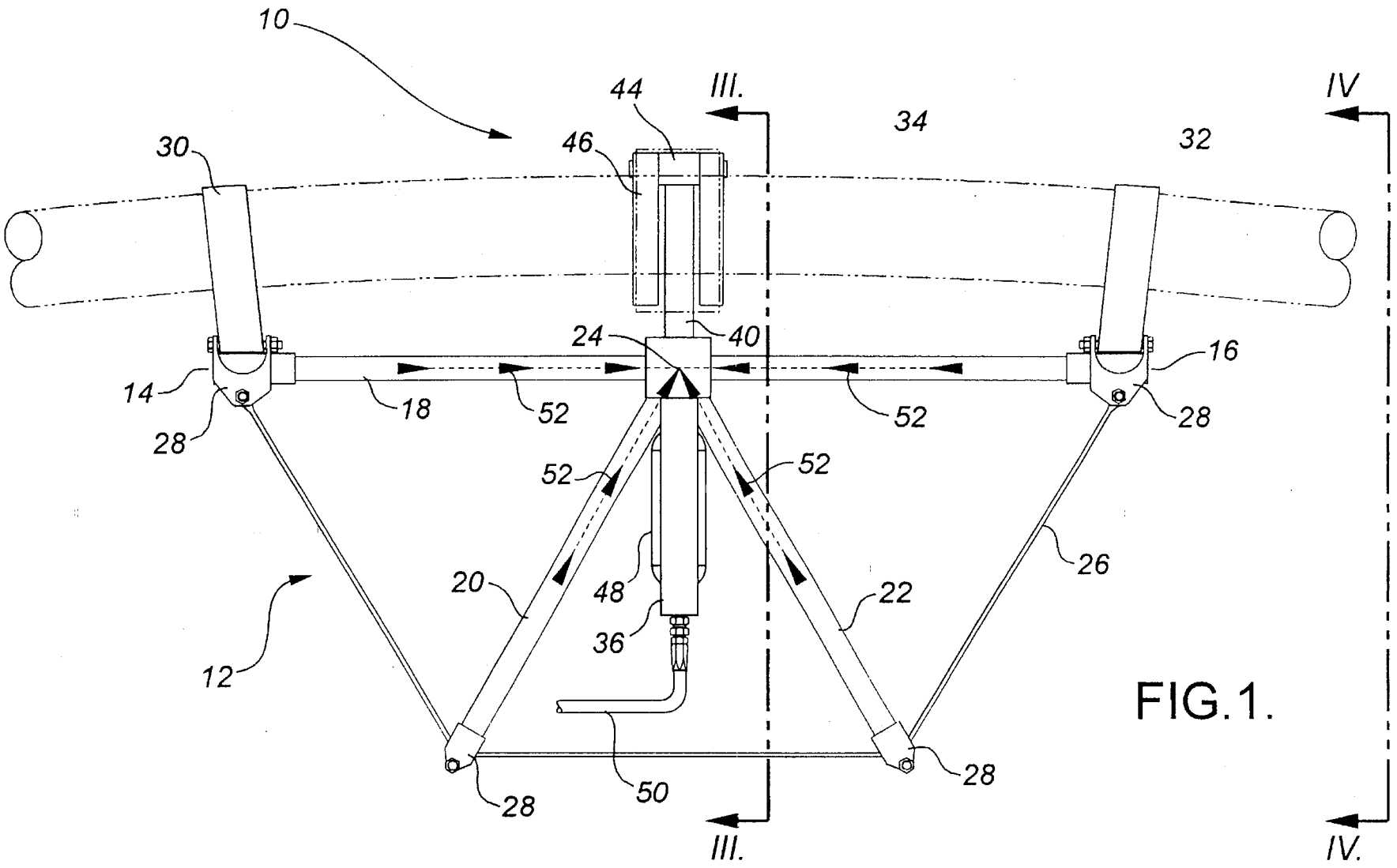
FIG. 1 is a top plan view of a pipe bending machine constructed in accordance with the teaching of the present invention.
Figure 2:
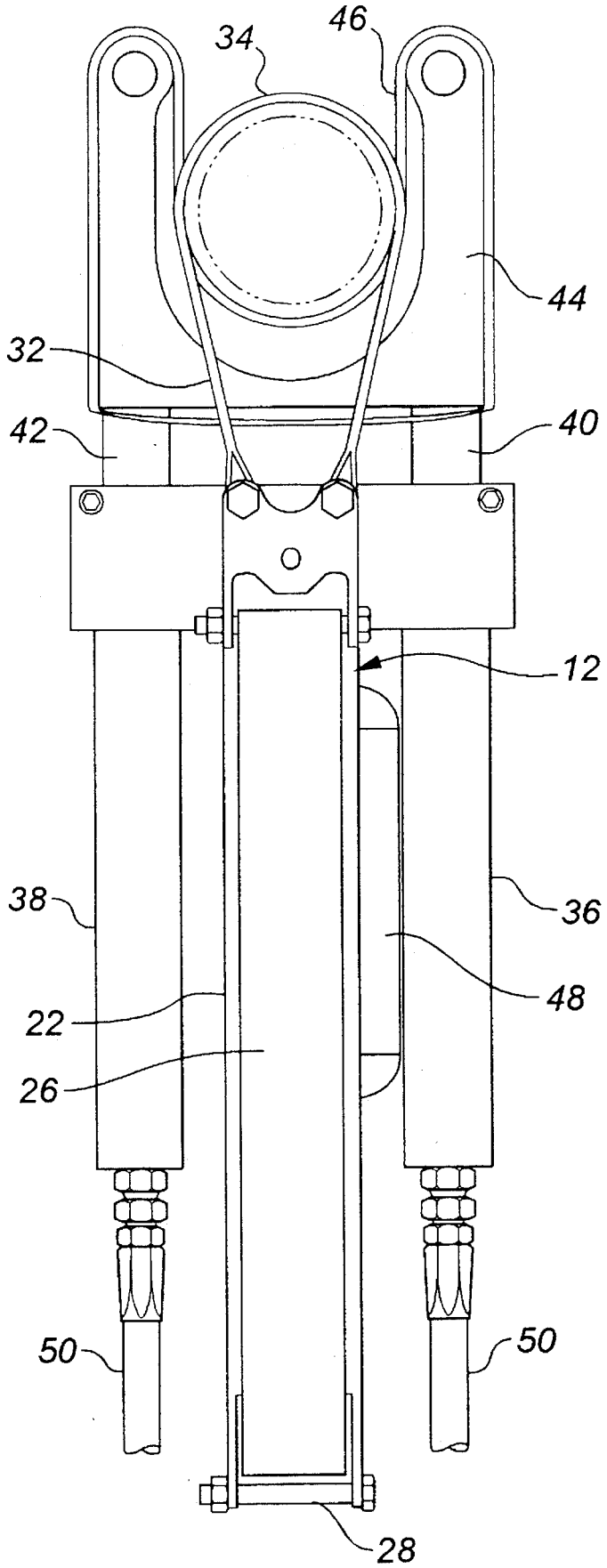
FIG. 2 is an end elevation view taken from a viewpoint defined by section lines 2—2 of FIG. 1.
Figure 3:
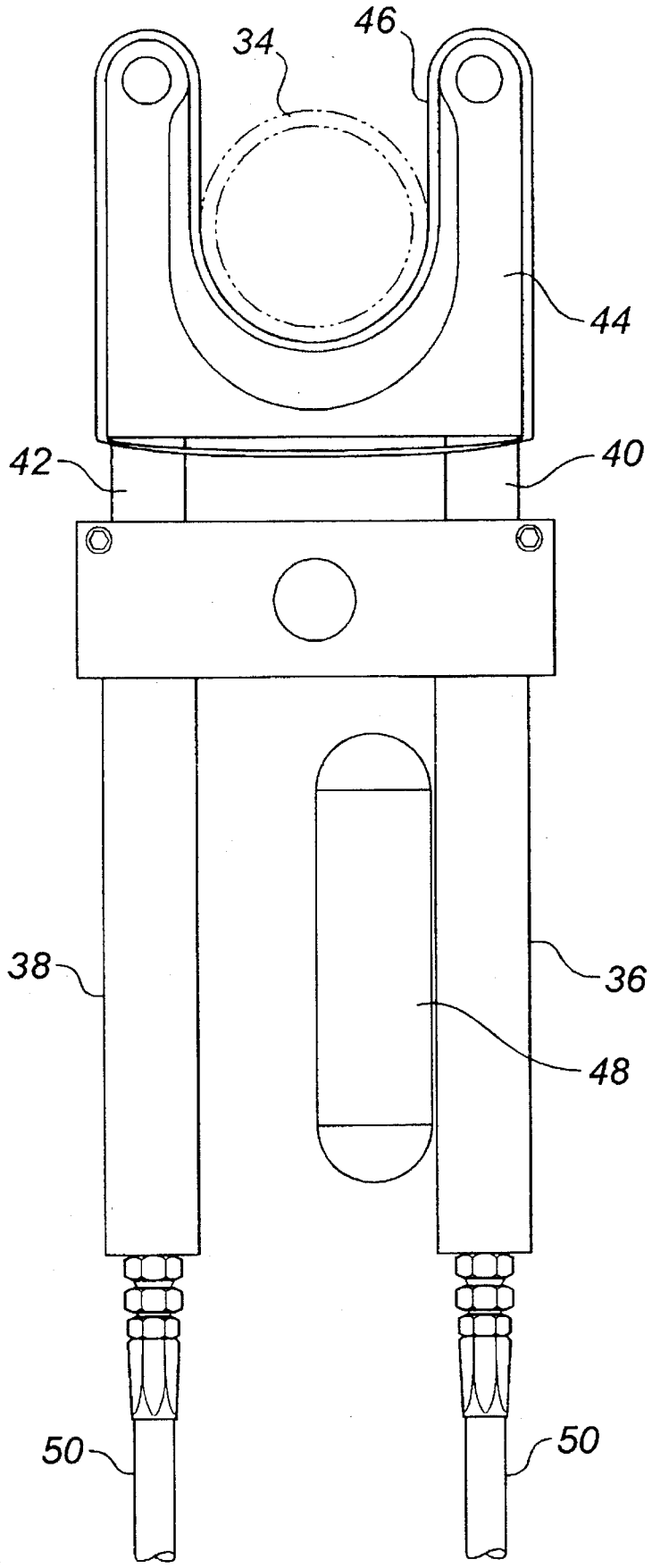
FIG. 3 is a section view taken along section lines 3—3 of FIG. 1.

The preferred embodiment, a pipe bending machine generally identified by reference numeral 10, will now be described with reference to FIGS. 1 through 3.

Pipe bending machine 10 has a cord and lattice support structure, generally identified by reference numeral 12. Cord and Lattice support structure 12 has a first end 14, a second end 16, and an interior lattice framework consisting of a primary member 18 which extends between first end 14 and second end 16, and two secondary members 20 and 22 which extend radially outwardly from a midpoint 24 of primary member 18 at an angle of substantially 45 degrees. An exterior connecting cord, in the form of a belt 26, connects a periphery of the interior lattice framework by connection to remote ends 28 of each of members 18, 20, and 22. Pipe securing means are provided in the form of tie back straps 30 and 32 which are secured to primary member 18 of support structure 12 adjacent first end 14 and second end 16, respectively. In order to bend a pipe 34, the pipe 34 is secured by means of tie back straps 30 and 32 to first end 14 and second end 16 of support structure 12. Pressure exerting means are provided which include a pair of parallel spaced hydraulic cylinders 36 and 38 which are secured to primary member 18 of support structure 12 intermediate first end 14 and second end 16. Each of hydraulic cylinders 36 and 38 has a pressure member 40 and 42, respectively, movable in relation to primary member 18 of support structure 12. A pipe engaging cradle 44 with a flexible fabric membrane 46 extends between pressure members 40 and 42. The hydraulic systems includes an hydraulic accumulator 48 and hydraulic fluid supply lines 50 which are adapted for connection to an hydraulic pump (not shown) powered by a portable power source (not shown).

The use and operation of pipe bending machine 10 will now be described with reference to FIGS. 1 through 3. Pipe 34 is secured by tie back strap 30 to first end 14 and by tie back strap 32 to second end 16 of support structure 12. Hydraulic fluid supply lines 50 are connected to the hydraulic pump (not shown) which supplies hydraulic fluid to hydraulic cylinders 36 and 38, causing pressure members 40 and 42 to move in unison. A pressure members 40 and 42 move pipe 34 is engaged by flexible fabric membrane 46 of pipe engaging cradle 44. Upon continued movement of pressure members 40 and 42, a bending force is exerted upon pipe 34. The bending force exerts a corresponding force upon support structure 12, as indicated by force vector arrows 52. It should be noted that the bending force places the interior lattice framework consisting of members 18, 20 and 22 in compression and belt-form connecting cord 26 in tension. The forces of compression and tension are off-setting thereby enabling support structure 12 to withstand the bending force.

It will be apparent to one skilled in that art that cord and lattice support structure 12 is light weight and yet provides the requisite strength for bending small diameter pipe of between 2 inches and six inches. It will also be apparent to one skilled in the art that modifications may be made to the illustrated embodiment without departing from the spirit and scope of the invention as defined by the claims. In particular, changes can be made to the particular configuration of cord and lattice support structure, the pipe securing means and the pressure exerting means.

The embodiments of the invention in which an exclusive property or privilege is claimed are as follows:

1. A pipe bending machine, comprising:

a cord and lattice support structure having a first end, a second end, an interior lattice framework and an exterior connecting cord which connects the periphery of the interior lattice framework;

pipe securing means secured to the support structure adjacent each of the first end and the second end; and pressure exerting means secured to the support structure intermediate the first end and the second end, the pressure exerting means having a pressure member movable in relation to the support structure thereby exerting a bending force upon a pipe held by the pipe securing means, the bending force placing the interior lattice framework in compression and the connecting cord in tension, the forces of compression and tension being off-setting thereby enabling the support structure to withstand the bending force.

2. The pipe bending machine as defined in claim 1, wherein the interior lattice framework includes a primary member which extends between the first end and the second end, and a plurality of secondary members extending radially outwardly from a midpoint of the primary member.

3. The pipe bending machine as defined in claim 2, wherein two secondary members extend radially outwardly from the midpoint of the primary member at an angle of 45 degrees.

4. The pipe bending machine as defined in claim 1, wherein the pressure exerting means includes a flexible fabric pipe engaging cradle.

5. The pipe bending machine as defined in claim 1, wherein the pressure exerting means includes at least one hydraulic cylinder adapted for connection to an hydraulic pump powered by a portable power source.

6. A pipe bending machine, comprising:

a cord and lattice support structure having a first end, a second end, an interior lattice framework and an exterior connecting cord which connects the periphery of the interior lattice framework, the interior lattice framework including a primary member which extends between the first end and the second end, and two secondary members extending radially outwardly from a midpoint of the primary member at an angle of substantially 45 degrees;

tie back straps secured to the support structure adjacent each of the first end and the second end, such that a pipe is secured by means of the tie back straps to the first end and the second end of the support structure; and a pair of parallel spaced hydraulic cylinders secured to the support structure intermediate the first end and the second end, each of the hydraulic cylinders having a pressure member movable in relation to the support structure, a pipe engaging cradle with a flexible membrane extending between the pressure members such that upon movement of the pressure members a bending force is exerted upon the pipe held by the tie back straps, the bending force placing the interior lattice framework in compression and the connecting cord in tension, the forces of compression and tension being off-setting thereby enabling the support structure to withstand the bending force, the hydraulic cylinders being adapted for connection to an hydraulic pump powered by a portable power source.

* * * * *